US009671760B2

(12) United States Patent
Kim

(10) Patent No.: US 9,671,760 B2
(45) Date of Patent: Jun. 6, 2017

(54) PORTABLE TERMINAL, WIRELESS CHARGING DEVICE, AND WIRELESS CHARGING STRUCTURE THEREOF

(71) Applicant: SAMSUNG ELECTRO-MECHANICS CO., LTD., Suwon (KR)

(72) Inventor: Ju Rae Kim, Suwon (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 172 days.

(21) Appl. No.: 14/540,562

(22) Filed: Nov. 13, 2014

(65) Prior Publication Data

US 2015/0130411 A1 May 14, 2015

(30) Foreign Application Priority Data

Nov. 14, 2013 (KR) ..... 10-2013-0138630

(51) Int. Cl.
*G04C 10/00* (2006.01)
*G04G 17/00* (2013.01)
*G04G 19/00* (2006.01)

(52) U.S. Cl.
CPC ..... *G04C 10/00* (2013.01); *G04G 17/00* (2013.01); *G04G 19/00* (2013.01)

(58) Field of Classification Search
CPC ..... G04C 10/00
See application file for complete search history.

(56) References Cited

U.S. PATENT DOCUMENTS

2003/0099161 A1* 5/2003 Bisig ..... G04C 10/00 368/82
2007/0146218 A1* 6/2007 Turner ..... H01Q 1/273 343/718
2008/0111518 A1* 5/2008 Toya ..... H02J 7/025 320/108
2013/0214890 A1* 8/2013 Zabaco ..... H01F 17/0013 336/200
2014/0143933 A1* 5/2014 Low ..... G04C 10/00 2/170
2014/0177399 A1* 6/2014 Teng ..... G04G 19/00 368/204
2014/0187157 A1* 7/2014 Liao ..... H04B 5/0037 455/41.1
2015/0341476 A1* 11/2015 Hogue ..... G04R 60/04 455/575.7

OTHER PUBLICATIONS

EP0308935—Translation. Baro, Jose, Antenna Bracelet for a radio reciver incorporated in a watch, Mar. 1989.*

* cited by examiner

*Primary Examiner* — Drew A Dunn
*Assistant Examiner* — Tynese McDaniel
(74) *Attorney, Agent, or Firm* — NSIP Law

(57) ABSTRACT

A portable terminal according to the present disclosure may include an information display part including a display screen displaying information and a battery; and a band part fastened to the information display part, wherein the band part includes a charging coil wirelessly receiving power to transfer the power to the battery.

1 Claim, 5 Drawing Sheets

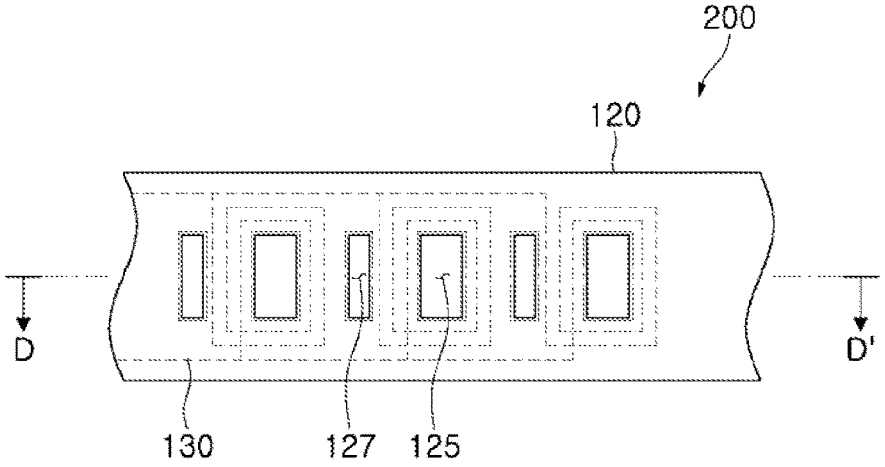
FIG. 7
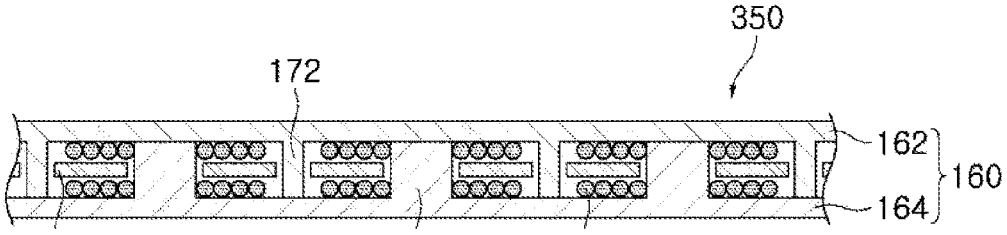

PORTABLE TERMINAL, WIRELESS CHARGING DEVICE, AND WIRELESS CHARGING STRUCTURE THEREOF

CROSS-REFERENCE TO RELATED APPLICATION

This application claims the benefit of Korean Patent Application No. 10-2013-0138630 filed on Nov. 14, 2013, with the Korean Intellectual Property Office, the disclosure of which is incorporated herein by reference.

BACKGROUND

The present disclosure relates to a portable terminal, a wireless charging device, and a wireless charging structure thereof, and more particularly, to a portable terminal capable of being worn on a wrist and able to be easily charged, a wireless charging device, and a wireless charging structure thereof.

Generally, in accordance with the trend toward high sensitivity, miniaturization, and lightness of electronic components, portable terminals have also become highly sensitive while being miniaturized and lightened. As first generation mobile phones, bar type mobile phones became common, while as second generation mobile phones, flip type mobile phones became generalized. Currently, flip type mobile phones and third generation folding type mobile phones tend to be generalized and coexist on the market.

In addition, recently, watch-type portable terminals that are wearable on the wrist of a user have been developed and released.

In general, watch-type portable terminals have a rechargeable battery embedded therein. Therefore, there is a need to periodically supply power to the battery for the battery to be charged.

However, according to the related art, a method of directly connecting a power supply cable from an adaptor to the watch-type portable terminal to charge the battery therein has been mainly used. Therefore, such a watch-type portable terminal should be repetitively connected to the cable whenever the battery thereof is to be charged.

RELATED ART DOCUMENT (Patent Document 1) Korean Patent Laid-Open Publication No. 2011-0064237

SUMMARY

An exemplary embodiment in the present disclosure may provide a wrist wearable portable terminal capable of being wirelessly charged, a wireless charging device, and a wireless charging structure thereof.

According to an aspect of the present disclosure, a portable terminal may include: an information display part including a display screen displaying information and a battery; and a band part fastened to the information display part, wherein the band part includes a charging coil wirelessly receiving power to transfer the power to the battery.

The band part may include at least one through hole, and the charging coil may be disposed in a spiral manner, based on the at least one through hole.

The band part may include a fastening member provided at one end thereof, and the band part may be formed to have a ring shape capable of being worn on a wrist by the coupling of fastening member and the at least one through hole.

The charging coil may be formed in the manner of a board to thereby be embedded in the band part.

The charging coil may be formed in the manner of a wire to thereby be embedded in the band part.

The band part may include a plurality of through holes, and the charging coil may be disposed in a spiral manner, around a circumference of each of the plurality of through holes.

The charging coils disposed around the circumference of each of the plurality of through holes may be connected in parallel to each other.

The charging coils disposed around the circumference of each of the plurality of through holes may be connected in series to each other.

The band part may further include an auxiliary hole disposed between each of the plurality of through holes.

According to an embodiment inaspect in the present disclosure, a wireless charging device may include: a core part including upper and lower cores; a protrusion part protruding from at least one of the upper and lower cores; and a transmission coil disposed in a spiral manner, based on the protrusion part.

In the core part, the upper and lower cores may be coupled to each other in a manner in which a distal end of the protrusion part comes into surface-contact with the core part.

The protrusion part may be formed from the lower core, and the upper core may be formed to have a flat plate shape.

The protrusion part may be formed from each of the upper and lower cores, and in the core part, the upper and lower cores may be coupled to each other in a manner in which distal ends of the protrusion parts come into surface-contact with each other.

The protrusion part may be formed from each of the upper and lower cores, and in the core part, the upper and lower cores may be coupled to each other in a manner in which the protrusion parts are offset from each other.

The transmission coil may be formed in the manner of a coil board or a wire.

According to an embodiment inaspect in the present disclosure, a wireless charging structure may include: a wireless charging device including upper and lower cores, a protrusion part protruding from at least one of the upper and lower cores, and a transmission coil disposed in a spiral manner, based on the protrusion part; and a portable terminal interposed between the upper and lower cores so that the protrusion part is inserted into a through hole formed therein, wherein in the portable terminal, a charging coil is disposed around a circumference of the through hole.

According to an embodiment inaspect in the present disclosure, a wireless charging structure may include: a wrist wearable portable terminal including a charging coil embedded in a band part; and a wireless charging device in which the band part of the portable terminal is interposed between upper and lower cores, and power is wirelessly transmitted to the charging coil through a transmission coil disposed on the upper or lower core.

The band part may include at least one through hole formed therein, and at least one of the upper and lower cores may include a protrusion part inserted into the at least one through hole.

The charging coil may be disposed around a circumference of the at least one through hole, and the transmission coil may be disposed around a circumference of the protrusion part.

BRIEF DESCRIPTION OF DRAWINGS

The above and other aspects, features and other advantages of the present invention will be more clearly understood from the following detailed description taken in conjunction with the accompanying drawings, in which:

FIG. 7 is a partial plan view schematically illustrating a band part of a portable terminal according to an exemplary embodiment in the present disclosure;

FIGS. 8 and 9 are cross-sectional views schematically illustrating a wireless charging device of the portable terminal illustrated in FIG. 7.

DETAILED DESCRIPTION

Figure 1:
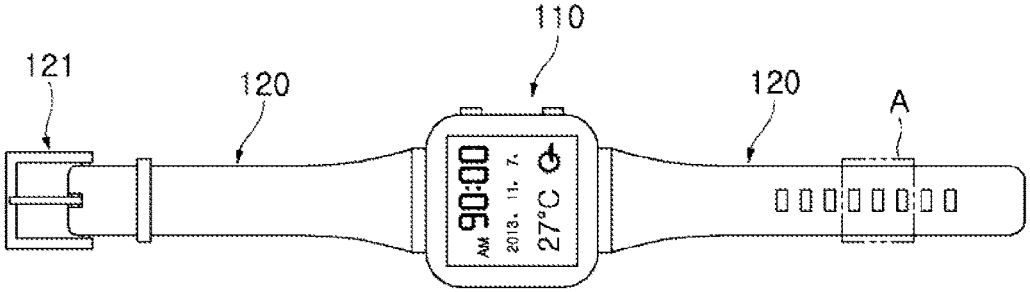
FIG. 1 is a plan view schematically illustrating a portable terminal according to an exemplary embodiment in the present disclosure.

Hereinafter, embodiments in the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Figure 2:
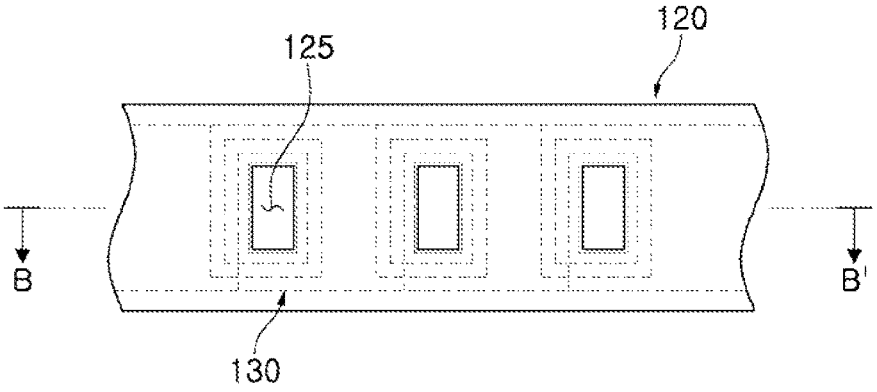
FIG. 2 is a partially enlarged transparent plan view of part A of FIG. 1.

FIG. 1 is a plan view schematically illustrating a portable terminal according to an exemplary embodiment in the present disclosure, and FIG. 2 is a partially enlarged transparent plan view of part A of FIG. 1. In addition, FIG. 3 is a cross-sectional view taken along line B-B' of FIG. 2.

Figure 3:
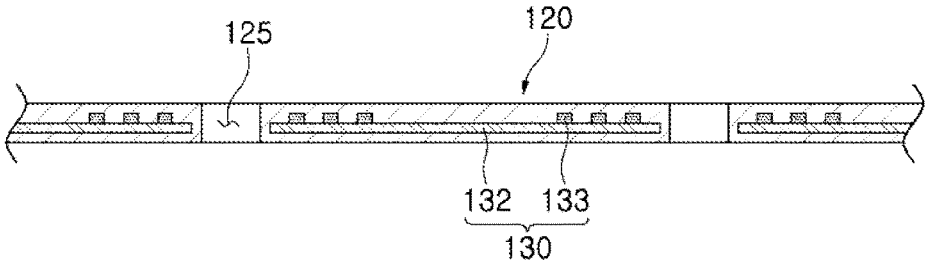
FIG. 3 is a cross-sectional view taken along line B-B' of FIG. 2.

Referring to FIGS. 1 through 3, a portable terminal 100 according to the present exemplary embodiment may include an information display part 110 and a band part 120.

The information display part 110 may display various types of information to a user of the portable terminal 100. Here, information may include visual information and include all of information related to various contents requested by or additionally supplied to a user.

To this end, the information display part 110 may include a display screen on which information is displayed to the user, an input button receiving a request from the user, and a battery supplying power to the portable terminal 100.

Here, as the display screen, a liquid crystal display (LCD) may be used, but the present disclosure is not limited thereto. In addition, the input button may include a physical button or touch screen.

The battery may be embedded in the information display part 110 and supply power to the display screen, or the like. In addition, the battery may be electrically connected to a charging coil 130 to be described below.

Meanwhile, the case in which the battery is embedded in the information display part 110 is described by way of example in the present exemplary embodiment, but a configuration of the present disclosure is not limited thereto. The present disclosure may be variously modified. For example, the battery may be embedded in a band part 120 to be described below.

The band part 120 may be fastened to the information display part 110 to wear the information display part 110 on a wrist of a user. Therefore, the band part 120 may be formed of a flexible material. More specifically, the band part 120 may be formed of a resin or rubber material. However, the present disclosure is not limited thereto.

The present disclosure may be variously modified. For example, the band part may be formed using an insulating material containing ferrite or metal particles.

Two band parts 120 may be fastened to both ends of the information display part 110, respectively, as illustrated in FIG. 1, and a fastening member 121 may be provided at one end of any one of the band parts 120. In addition, at least one through hole 125 may be formed in the other band part 120.

Here, the through hole 125 may be a hole for coupling the fastening member 121. Therefore, the band part 120 may have a ring shape by the coupling of the fastening member 121 and the through hole 125, such that the band part 120 may be worn a wrist of a user, or the like. However, the configuration of the present disclosure is not limited thereto. That is, the through hole 125 may also be formed in the band part 120 to which the fastening member 121 is coupled.

In addition, the band part 120 according to the present exemplary embodiment may include the charging coil 130. The charging coil may be provided in a manner in which the charging coil is attached to one surface of the band part 120 or in a manner in which the charging coil is embedded in the band part 120. FIG. 2 transparently illustrates the charging coil 130 embedded in the band part 120.

The charging coil 130 may be provided in order to charge the battery embedded in the information display part 110.

The charging coil 130 may be embedded in the band part 120 in a form of a coil board 132.

In this case, as the coil board, a film or a flexible printed circuit board (PCB) having a reduced thickness and including a wiring pattern formed thereon such as a thin printed circuit board, or the like, may be used.

A coil pattern 133 formed on the coil board 132 may be formed in the manner of a wiring pattern on at least one surface of the coil board 132. In the present exemplary embodiment, the coil pattern 133 may be formed on both surfaces of the coil board 132 in a spiral shape, and both ends thereof may be electrically connected to the battery.

In the case in which the coil pattern 133 is formed on both surfaces of the coil board 132, in each of the coil patterns 133, both ends thereof may be electrically connected to thereby entirely form a parallel circuit, or one end of the center thereof may be connected to thereby form a serial circuit.

In addition, a conductive via (not shown) for electrically connecting the coil patterns 133 may be formed in the coil board 132. Therefore, in the case of portions on which the coil patterns 133 are overlapped with each other, the coil pattern 133 may be formed on the other surface of the coil board through the conductive via.

Meanwhile, although the case in which the coil pattern 133 has a generally rectangular spiral shape is described by way of example in the present exemplary embodiment, the present disclosure is not limited thereto but may be variously modified. For example, the coil pattern 133 may have a circular spiral shape, a polygonal spiral shape, or the like.

Further, the charging coil 130 according to the present exemplary embodiment may be formed in the spiral manner, around a circumference of the through hole 125 based on the through hole 125 of the band part 120. Therefore, in the case in which a plurality of through holes 125 are formed in the band part 120, the coil pattern 133 may be formed around each of the through holes 125.

Each of the coil patterns 133 as described above may be electrically connected to each other. For example, as illustrated in FIG. 3, the coil patterns 133 formed around the circumference of each of the through holes 125 may be connected in parallel to each other. However, the present disclosure is not limited thereto.

Meanwhile, the case in which the charging coil 130 is provided in a form of a thin board is described by way of example in the present exemplary embodiment, but the configuration of the present disclosure is not limited thereto. The present disclosure may be variously modified. For example, the charging coil 130 may be formed in the manner of a conducting wire, that is, a wire to thereby be embedded in the band part 120.

The portable terminal 100 configured as described above may be supplied with power by a wireless charging device 150 to be described below.

Figure 4:
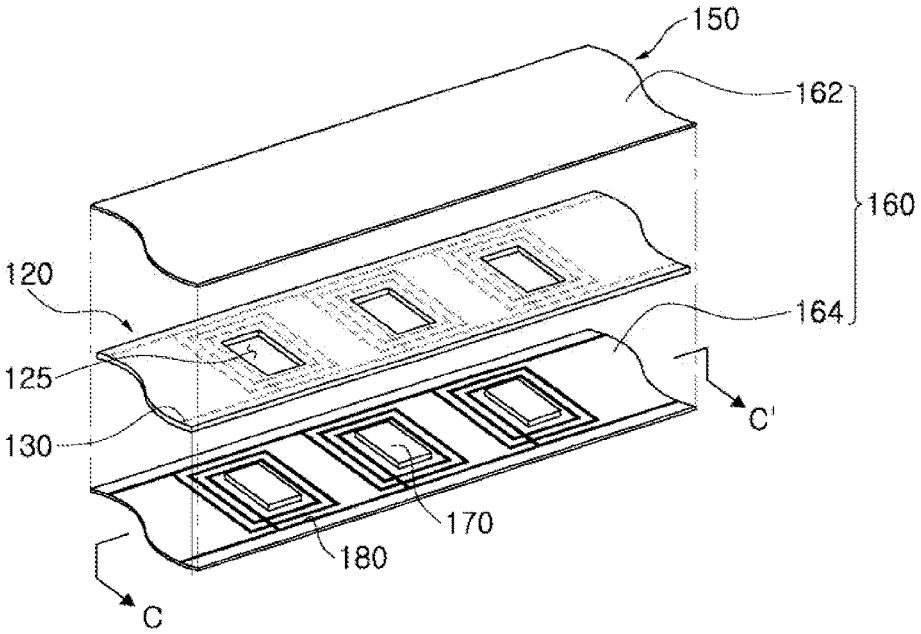
FIG. 4 is a perspective view schematically illustrating a wireless charging device according to an exemplary embodiment in the present disclosure.
Figure 5:
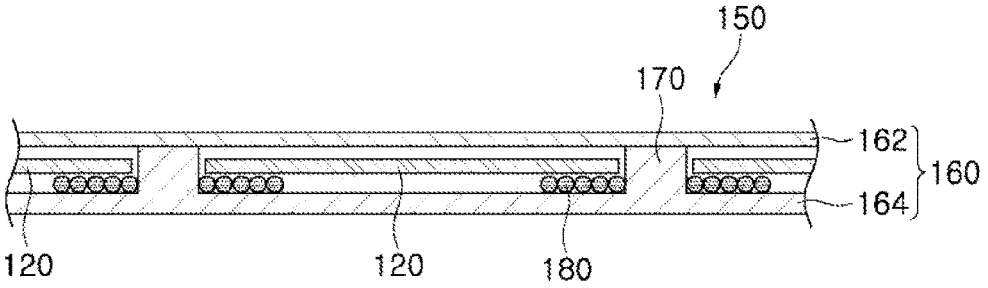
FIG. 5 is a cross-sectional view taken along line C-C' of FIG. 4.

FIG. 4 is a perspective view schematically illustrating a wireless charging device according to an exemplary embodiment in the present disclosure; and FIG. 5 is a cross-sectional view taken along line C-C' of FIG. 4.

Referring to FIGS. 4 and 5, the wireless charging device 150 according to the present exemplary embodiment may be provided in order to charge the battery of the portable terminal 100.

The wireless charging device 150 may convert household alternate current (AC) power supplied from the outside into direct current (DC) power and again convert the DC current into AC voltage having a predetermined frequency to thereby provide the AC voltage to the portable terminal 100. To this end, the wireless charging device 150 may include a core part 160 and a transmission coil 180.

The band part 120 of the portable terminal 100 may be mounted in the core part 160. To this end, the core part 160 may include upper and lower cores 162 and 164. The upper and lower cores 162 and 164 may be coupled to each other to form a continuous magnetic circuit.

In addition, the core part 160 may include at least one protrusion part 170 inserted into the through hole 125 of the band part 120 of the portable terminal 100. Therefore, the protrusion part 170 may be formed to have a shape corresponding to a shape of the through hole.

The case of forming a plurality of protrusion parts 170 on the lower core 164 and forming the upper core 162 in a flat plate shape to thereby form the core part 160 in an entirely "EI" shape is described by way of example in the present exemplary embodiment. In this case, the upper core 162 may be coupled to the lower core 164 while coming into contact with a distal end of the protrusion part 170 of the lower core 164 to form a completed magnetic circuit.

However, the configuration of the present disclosure is not limited thereto, but may be variously modified as in other exemplary embodiments to be described below.

As the protrusion part 170 is provided, the portable terminal 100 may be seated in the wireless charging device 150 so that the protrusion part 170 is inserted into the through hole 125 of the band part 120. Therefore, the portable terminal 100 according to the present exemplary embodiment may always be seated at the same position. In addition, since the charging coil 130 of the portable terminal 100 may always be disposed in a position corresponding to a transmission coil 180 to be described below by the protrusion part 170, charging efficiency may be improved.

The transmission coil 180 may be wound in a spiral manner, based on the protrusion part 170 formed from the core part 160. The transmission coil 180 may be formed in the manner of a coil board similarly to the charging coil 130 of the portable terminal 100 and formed in the manner of a wire as in the present exemplary embodiment.

In addition, the transmission coil 180 may be disposed around all of the protrusion parts 170 as in the present exemplary embodiment, but the present disclosure is not limited thereto. If necessary, the transmission coil 180 may be selectively disposed.

A wireless charging method using a wireless charging structure according to the present exemplary embodiment configured as described above is as follows.

First, the band part 120 of the portable terminal 100 may be mounted on the lower core 164 in a state in which the upper core 162 of the wireless charging device 150 is opened. In this case, the protrusion part 170 of the lower core 164 may be disposed so as to be inserted into the through hole 125 of the band part 120.

Subsequently, the upper core 162 may be coupled to the lower core 164. Therefore, the core part 160 may form a closed magnetic circuit.

Then, AC voltage may be applied to the transmission coil 180 of the wireless charging device 150, thereby changing a magnetic field around the transmission coil 180. Therefore, the charging coil 130 of the portable terminal 100 coupled to the wireless charging device 150 may be applied with voltage according to a change in the magnetic field, such that the battery of the portable terminal 100 is charged.

Meanwhile, the wireless charging device according to the present disclosure is not limited to the above-mentioned embodiment but may be variously modified.

Figure 6:
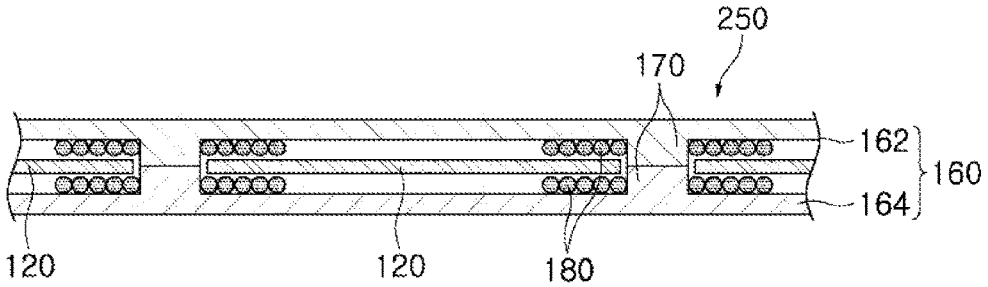
FIG. 6 is a cross-sectional view schematically illustrating a wireless charging device according to an exemplary embodiment in the present disclosure.

FIG. 6, which is a cross-sectional view schematically illustrating a wireless charging device 250 according to an exemplary embodiment in the present disclosure, illustrates a cross section corresponding to the cross section of FIG. 4, taken line C-C.

Referring to FIG. 6, in the wireless charging device 250 according to the present exemplary embodiment, an upper core 162 and a lower core 164 may be formed to have an EE shape and coupled to each other. That is, protrusion parts 170 may also be formed from the upper core 162.

Therefore, the protrusion part 170 according to the present exemplary embodiment is formed to have a protrusion length shorter than that of the protrusion part 170 according to the above-mentioned exemplary embodiment, and the upper and lower cores 162 and 164 may be coupled to each other in a manner in which distal ends of the protrusion parts 170 come into surface-contact with each other, respectively.

Therefore, in the wireless charging device 250 according to the present exemplary embodiment, a transmission coil 180 may be disposed on the upper core 162 as well as the lower core 164. In this case, the transmission coil 180 may be disposed in a spiral manner, based on the protrusion part 170, similarly to the above-mentioned exemplary embodiment.

In the wireless charging structure according to the present exemplary embodiment configured as described above, the charging coil 130 may be embedded in the band part 120 of the portable terminal 100. Therefore, the charging coil 130 may be disposed on a wider area as compared to the case of forming the charging coil 130 in the information display part 110 or the fastening member 121, such that charging efficiency may be improved.

Further, in the wireless charging devices 150 and 250 according to the present exemplary embodiments, the protrusion part 170 may penetrate through the through hole 125 formed in the band part 120 of the portable terminal 100 to thereby be coupled thereto, thereby forming a closed magnetic circuit. Therefore, since a leakage magnetic flux generated during a charging process may be significantly decreased, charging efficiency may be improved.

In addition, since the protrusion part 170 is inserted into the through hole 125, at the time of charging, the charging coil 130 and the transmission coil 180 may always be disposed at regular intervals. Therefore, whenever the battery is charged, optimal charging efficiency may be maintained.

In addition, since the core part 160 is disposed in a shape in which the core part 160 encloses the charging coil 130 of the portable terminal 100, an effect of shielding electromagnetic waves from being introduced into the charging coil 130 from the outside may be obtained.

Meanwhile, the portable terminal, the wireless charging device, and the wireless charging structure according to the present disclosure are not limited to the above-mentioned exemplary embodiments, but may be variously modified.

FIG. 7, which is a partial plan view schematically illustrating a band part of a portable terminal according to an exemplary embodiment in the present disclosure, illustrates a plan corresponding to that in FIG. 2. In addition, FIGS. 8 and 9, which are cross-sectional views schematically illustrating a wireless charging device of the portable terminal illustrated in FIG. 7, show cross sections corresponding to that in FIG. 5.

First, referring to FIG. 7, a portable terminal 200 according to the present exemplary embodiment may further include an auxiliary hole 127 in addition to a through hole 125 described in the above-mentioned exemplary embodiment.

A single or a plurality of auxiliary holes 127 may be disposed between the through holes 125 so as to be spaced apart from each other by a predetermined interval.

Accordingly, as illustrated in FIG. 8, a wireless charging device 350 according to the present exemplary embodiment may include a protrusion part 170 inserted into the through hole 125 and a protrusion part 172 inserted into the auxiliary hole 127.

The case in which the protrusion part 170 inserted into the through hole 125 is formed from a lower core 164, and the protrusion part 172 inserted into the auxiliary hole 127 is formed from an upper core 162 is illustrated by way of example in FIG. 8. In this case, the protrusion part 170 of the upper core 162 and the protrusion part 172 of the lower core 164 may be coupled to each other in a manner in which they are offset from each other.

In the case in which the auxiliary hole 127 is formed in the band part 120 and the protrusion part 172 is coupled through the auxiliary hole 127 as described above, since a magnetic circuit may be further expanded by the protrusion part 172 of the auxiliary hole 127, leakage or saturation of a magnetic flux may be significantly decreased.

Figure 9:
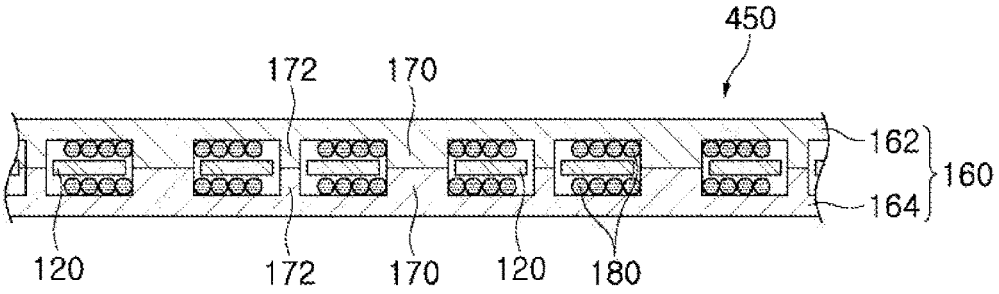

In addition, in FIG. 9, protrusion parts 170 are formed from both of the upper and lower cores 162 and 164, similarly to the above-mentioned exemplary embodiment illustrated in FIG. 6 such that the upper and lower cores 162 and 164 may be coupled to each other so that distal ends of the protrusion parts 170 come into surface-contact with each other. Therefore, each of the protrusion parts 170 may come into contact with each other in the through hole 125 and the auxiliary hole 127.

Figure 10:
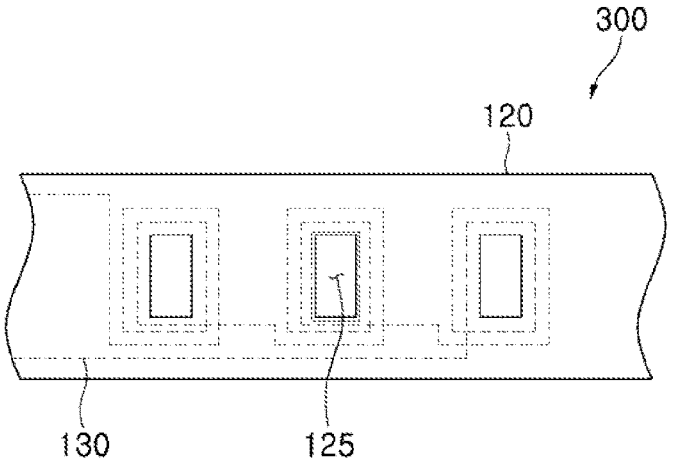
FIG. 10 is a partial plan view schematically illustrating a band part of a portable terminal according to an exemplary embodiment in the present disclosure.

FIG. 10, which is a partial plan view schematically illustrating a band part of a portable terminal according to an exemplary embodiment in the present disclosure, illustrates a plan corresponding to that in FIG. 2.

In a portable terminal 300 according to the present exemplary embodiment, charging coils 130 provided in a band part 120 are connected in series to each other. That is, coils formed around each of the through holes 125 may entirely form a single serial circuit.

Meanwhile, although the case in which only a single coil strand is formed on the coil board is described by way of example in the above-mentioned exemplary embodiment, the configuration of the present disclosure is not limited thereto. That is, the present disclosure may be variously modified. For example, the coil board may be formed so as to have a plurality of coil strands.

In addition, although the case in which only a single through hole is disposed in the center of the spiral shaped pattern is described by way of example in the above-mentioned exemplary embodiments, the configuration of the present disclosure may be variously modified. That is, two or more through holes may be disposed in the center of the spiral shaped pattern. In this case, a transmission coil of a wireless charging device may be formed to have a shape corresponding thereto.

In addition, although the portable terminal worn on a wrist is described by way of example in the above-mentioned exemplary embodiments, the present disclosure is not limited thereto, and the present disclosure may be widely applied to various portable products capable of being worn such as a belt, a necklace, or the like.

As set forth above, in the wireless charging structure according to exemplary embodiments in the present disclosure, the charging coil is embedded in the band part of the portable terminal. Therefore, the charging coil may be disposed on a wider area as compared to the case of forming the charging coil in the information display part or in the fastening member, such that charging efficiency may be improved.

Further, in the wireless charging device according to exemplary embodiments in the present disclosure, the protrusion part may be coupled while penetrating through the through hole formed in the band part of the portable terminal, thereby forming the closed magnetic circuit. Therefore, since the leakage magnetic flux generated during the charging process may be significantly decreased, charging efficiency may be improved.

In addition, since the protrusion part is inserted into the through hole, at the time of charging, the charging coil and the transmission coil may always be disposed at regular intervals. Therefore, whenever the battery is charged, optimal charging efficiency may be maintained.

Further, at the time of charging, since the core part is disposed in a shape in which the core part encloses the charging coil of the portable terminal, the effect of shielding electromagnetic waves from being introduced into the charging coil from the outside may be obtained.

While exemplary embodiments have been shown and described above, it will be apparent to those skilled in the art that modifications and variations could be made without departing from the scope of the present invention as defined by the appended claims.

What is claimed is:

1. A wireless charging structure comprising:

a wireless charging device comprising upper and lower cores, and a transmission coil disposed in a spiral manner; and a portable terminal interposed between the upper and lower cores, wherein the portable terminal comprises a plurality of through holes and charging coils wirelessly receiving power, the charging coils are disposed around a circumference of each of the plurality of through holes, and the charging coils are connected to each other in parallel.

* * * * *